US007968644B2

(12) United States Patent
Sawauchi et al.

(10) Patent No.: US 7,968,644 B2
(45) Date of Patent: Jun. 28, 2011

(54) METHOD OF PRODUCING A FLUORORESIN AQUEOUS DISPERSION

(75) Inventors: Chie Sawauchi, Settsu (JP); Nobuhiko Tsuda, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 714 days.

(21) Appl. No.: 11/766,532

(22) Filed: Jun. 21, 2007

(65) Prior Publication Data

US 2008/0004393 A1 Jan. 3, 2008

(30) Foreign Application Priority Data

Jun. 29, 2006 (JP) ..... 2006-180246

(51) Int. Cl.
*C08L 27/12* (2006.01)

(52) U.S. Cl. ..... 524/544; 524/244; 524/502; 523/351
(58) Field of Classification Search ..... 524/544, 524/502, 244; 523/351
See application file for complete search history.

(56) References Cited

U.S. PATENT DOCUMENTS

| | | | | |
|---|---|---|---|---|
| 6,833,403 | B1 | 12/2004 | Bladel et al. | |
| 2004/0171736 | A1 * | 9/2004 | Dadalas et al. | 524/544 |
| 2004/0186219 | A1 * | 9/2004 | Dadalas et al. | 524/544 |
| 2005/0107506 | A1 * | 5/2005 | Kapeliouchko et al. | 524/379 |
| 2005/0154104 | A1 | 7/2005 | Malvasi et al. | |
| 2006/0041051 | A1 * | 2/2006 | Nakatani et al. | 524/544 |
| 2007/0282044 | A1 * | 12/2007 | Cavanaugh et al. | 524/244 |

FOREIGN PATENT DOCUMENTS

| | | | |
|---|---|---|---|
| CN | 1329622 | A | 1/2002 |
| CN | 1637025 | A | 7/2005 |
| JP | 2005-126715 | | 5/2005 |
| JP | 2005-171250 | | 6/2005 |
| WO | WO-2008-001846 | A1 * | 1/2008 |

* cited by examiner

*Primary Examiner* — Peter D. Mulcahy
*Assistant Examiner* — Henry Hu
(74) *Attorney, Agent, or Firm* — Sughrue Mion, PLLC

(57) ABSTRACT

The present invention provides a method of producing a fluororesin aqueous dispersion which can produce a fluororesin aqueous dispersion low in fluorine-containing surfactant concentration and high in polytetrafluoroethylene concentration with high efficiency. The invention provides a method of producing a fluororesin aqueous dispersion which comprises subjecting a crude fluororesin aqueous dispersion comprising a polytetrafluoroethylene particle dispersed in an aqueous medium to treatment with an ion-exchange resin and to treatment for concentration by phase separation in the presence of an electrolyte and/or a fluorine-free anionic surfactant.

5 Claims, No Drawings

METHOD OF PRODUCING A FLUORORESIN AQUEOUS DISPERSION

BACKGROUND OF THE INVENTION

1. Field of the Invention

The present invention relates to a method of producing a fluororesin aqueous dispersion.

2. Description of the Prior Art

Polytetrafluoroethylene-based fluororesin aqueous dispersions, when applied in the manner of coating or dipping, for instance, can form films or layers excellent in such characteristics as chemical stability, nonstickiness and weather resistance and, therefore, are widely used in such fields of application as cooking utensils, pipe linings and impregnated glass cloth membranes. In these fields of application, fluororesin aqueous dispersions having a high fluororesin concentration are generally preferred, so that those products obtained by polymerizing a fluoromonomer(s) in an aqueous medium in the presence of a fluorine-containing surfactant, followed by concentration are in current use. From the cost viewpoint, however, it is desirable that fluororesin aqueous dispersions be deprived of such a fluorine-containing surfactant.

For fluorosurfactant removal from fluororesin aqueous dispersions, a method has been proposed which comprises repeating a separation operation in the presence of a nonionic surfactant and an electrolyte substantially three times, each time separating the supernatant and recovering the lower phase (cf. e.g. Patent Document 1: Japanese Kokai (Laid-open) Publication 2005-126715 and Patent Document 2: Japanese Kokai Publication 2005-171250). However, this method requires substantially three repetitions of such concentration procedure.

In Patent Document 3 (United States Patent Application Publication 2004/186219) and Patent Document 4 (United States Patent Application Publication 2004/171736), there is described a fluororesin aqueous dispersion reduced in the content of ammonium perfluorooctanoate [PFOA] by means of an anion-exchange resin and further reduced in viscosity by addition of a fluorine-free anionic surfactant in an amount within the range of 1 to 12% relative to the fluororesin. However, these documents have no mention of the technique of concentration through phase separation.

SUMMARY OF THE INVENTION

In view of the above-discussed state of the prior art, it is an object of the present invention to provide a method of producing a fluororesin aqueous dispersion by which the fluororesin aqueous dispersion low in fluorine-containing surfactant concentration and high in polytetrafluoroethylene concentration can be produced with high efficiency.

The invention provides a method of producing a fluororesin aqueous dispersion which comprises subjecting a crude fluororesin aqueous dispersion comprising a polytetrafluoroethylene particle dispersed in an aqueous medium to treatment with an ion-exchange resin and to treatment for concentration by phase separation in the presence of an electrolyte and/or a fluorine-free anionic surfactant.

In the following, the invention is described in detail.

DETAILED DESCRIPTION OF THE INVENTION

The method of producing a fluororesin aqueous dispersion according to the invention makes it possible to reduce the fluorine-containing surfactant concentration in the product fluororesin aqueous dispersion to levels corresponding to 100 ppm of polytetrafluoroethylene [PTFE] or below and increase the PTFE concentration to levels of 45 to 75% by mass relative to the fluororesin aqueous dispersion. In the art, such a complicated process as repeated concentration is required for reducing the fluorine-containing surfactant content and at the same time increase the fluororesin concentration. On the contrary, according to the method of producing a fluororesin aqueous dispersion according to the invention, the fluororesin aqueous dispersion can be obtained efficiently by carrying out ion-exchange resin treatment and concentration treatment by phase separation in the presence of an electrolyte and/or a fluorine-free anionic surfactant while fulfilling both the surfactant reduction and resin concentration increase requirements.

The method of producing a fluororesin aqueous dispersion according to the invention is intended to produce a fluororesin aqueous dispersion from a crude fluororesin aqueous dispersion.

The crude fluororesin aqueous dispersion comprises a PTFE particle dispersed in an aqueous medium.

The "PTFE" so referred to herein conceptually includes not only TFE homopolymer but also modified polytetrafluoroethylene [modified PTFE] species. The term "modified PTFE" as used herein means a non-melt-processable copolymer of TFE and a small proportion of a minor component monomer other than TFE.

The minor component monomer includes, among others, fluoroolefins such as hexafluoropropylene and chlorotrifluoroethylene, fluoro(alkyl vinyl ether) compounds with an alkyl group containing 1 to 5 carbon atoms, in particular 1 to 3 carbon atoms; fluorodioxole; perfluoroalkylethylenes; and ω-hydroperfluoroolefins.

The content of the minor component monomer units derived from the minor component monomer relative to all the monomer units in the modified PTFE is generally 0.001 to 2 mole percent. The "content (in mole percent) of the minor component monomer units relative to all the monomer units" so referred to herein means the mole fraction (mole percent) of the minor component monomer from which the minor component monomer units are derived relative to the total amount of the monomers from which the "all monomer units" are derived, namely the total amount of the fluoropolymer-constituting monomers.

The PTFE particle generally has an average primary particle diameter of 40 to 400 nm. The average primary particle diameter is determined based on the transmittance, per unit length, of a sample aqueous dispersion adjusted to a PTFE concentration of 0.22% by mass at an incident light wavelength of 550 nm, using a working curve showing the relation between such transmittance and the average primary particle diameter determined by measurements of images on a scanning electron photomicrograph in a predetermined direction.

The aqueous medium mentioned above is not particularly restricted but any liquid containing water; thus, in addition to water, it may be an aqueous medium containing, for example, a fluorine-free organic solvent such as an alcohol, ether, ketone or paraffin wax and/or a fluorine-containing organic solvent.

The crude fluororesin aqueous dispersion may be one obtained by such after-treatment as fluorine-containing surfactant reducing treatment and/or concentration following the production of the above-mentioned PTFE by polymerization or one as obtained by carrying out the polymerization but not yet subjected to any concentration treatment (the so-called virgin aqueous dispersion). The fluorine-containing surfactant content in the virgin aqueous dispersion is generally at a level corresponding to 500 to 20000 ppm of the PTFE.

The concentration of the above-mentioned PTFE in the crude fluororesin aqueous dispersion is generally 5 to 70% by mass, preferably 5 to 60% by mass, more preferably 10 to 40% by mass, still more preferably 15 to 35% by mass.

The PTFE concentration (P) mentioned above is determined by taking about 1 g (X) of the sample in an aluminum cup having a diameter of 5 cm, drying the sample at 100° C. for 1 hour and further drying the sample at 300° C. for 1 hour to give a heating residue (Z), and making a calculation according to the formula: $P=Z/X\times100(\%)$.

The method of producing a fluororesin aqueous dispersion according to the invention gives a fluororesin aqueous dispersion by subjecting the above-mentioned crude fluororesin aqueous dispersion to treatment with an ion-exchange resin and concentration by phase separation in the presence of an electrolyte and/or a fluorine-free anionic surfactant.

The ion-exchange treatment can be preferably carried out by the method described in Japanese Kohyo Publication 2002-532583 (International Publication WO 00/35971) and, in cases where the content of such a fluorine-containing anionic surfactant as PFOA is to be reduced, the treatment is generally carried out using an anion-exchange resin.

The above-mentioned ion-exchange resin treatment can be effected, for example, by bringing the crude fluororesin aqueous dispersion, if necessary supplemented with a fluorine-free nonionic surfactant, into contact with an anion exchanger comprising a strongly basic resin adjusted in advance to the OH form.

The fluorine-free nonionic surfactant is not particularly restricted but may be any of those comprising a fluorine-free nonionic compound(s) known in the art. As the nonionic surfactant, there may be mentioned, for example, ether type nonionic surfactants such as polyoxyethylene alkylphenyl ethers, polyoxyethylene alkyl ethers and polyoxyethylene-alkylene alkyl ethers; polyoxyethylene derivatives such as ethylene oxide-propylene oxide block copolymers; ester type nonionic surfactants such as sorbitan fatty acid esters, polyoxyethylenesorbitol fatty acid esters, glycerol fatty acid esters and polyoxyethylene fatty acid esters; amine type nonionic surfactants such as polyoxyethylenealkylamines and alkylalkanolamides; and so forth.

The hydrophobic group in the compound constituting the fluorine-free nonionic surfactant may be an alkylphenol group, a straight alkyl group or a branched alkyl group. A benzene ring-free compound such a compound having no alkylphenol group in the structure thereof is preferred, however.

The fluorine-free nonionic surfactant is preferably a polyoxyethylene alkyl ether type nonionic surfactant, in particular. The polyoxyethylene alkyl ether type nonionic surfactant preferably has a polyoxyethylene alkyl ether structure having an alkyl group containing 10 to 20 carbon atoms, more preferably a polyoxyethylene alkyl ether structure having an alkyl group containing 10 to 15 carbon atoms. The alkyl group in the polyoxyethylene alkyl ether structure preferably has a branched structure.

As the polyoxyethylene alkyl ether type nonionic surfactant, there may be mentioned, for example, Genapol X080 (product name, product of Clariant), Tergitol 9-S-15 (product name, product of Clariant), Noigen TDS-80 (product name, product of Daiichi Kogyo Seiyaku) and Leocol TD90 (product name, product of Lion Corp.).

When the ion exchange treatment is carried out after addition of the fluorine-free nonionic surfactant, the concentration thereof is preferably at a level corresponding to 1 to 40% by mass, more preferably 1 to 30% by mass, still more preferably 1 to 20% by mass, relative to the PTFE.

The concentration (N) of the fluorine-free nonionic surfactant, so referred to herein, is determined in the following manner. About 1 g (X g) of the sample is placed in an aluminum cup having a diameter of 5 cm and heated at 100° C. for 1 hour to give a heating residue (Y g) and, further, the heating residue (Y g) obtained is heated at 300° C. for 1 hour to give a heating residue (Z g), and a calculation is made according to the formula: $N=[(Y-Z)/Z]\times100(\%)$.

The above-mentioned concentration by phase separation can be effected by adding, if necessary, such a fluorine-free nonionic surfactant to the crude fluororesin aqueous dispersion to such a concentration as described later herein, heating the crude fluororesin aqueous dispersion to cause separation into a PTFE-free phase (supernatant phase) and a PTFE-containing phase (concentrated phase) and removing the PTFE-free phase to obtain the PTFE-containing phase.

The separation of the PTFE-free phase from the PTFE-containing phase is preferably carried out within a temperature range of the cloud point of the fluorine-free nonionic surfactant ±15° C., more preferably ±10° C.

The cloud point so referred to above means the temperature at which the aqueous fluorine-free nonionic surfactant solution rendered cloudy by heating becomes again wholly transparent upon gradual cooling. The cloud point so referred to herein is the value measured by placing 15 ml of the diluted measurement sample in a test tube, heating the same until it becomes completely opaque and, then, cooling the same gradually with stirring and measuring the temperature at which the whole liquid becomes transparent, according to ISO 1065 (Method A).

The method of removing the PTFE-free phase is not particularly restricted but may be any of the methods known in the art, for example decantation.

The concentration by phase separation is carried out in the presence of an electrolyte and/or a fluorine-free anionic surfactant. The method of producing a fluororesin aqueous dispersion according to the invention makes it possible to efficiently concentrate an aqueous dispersion, even when it is very low in fluorine-containing surfactant content, by causing an electrolyte and/or a fluorine-free anionic surfactant in the step of concentration by phase separation.

In carrying out the concentration by phase separation, the pH is not particularly restricted but it is preferably 4 to 11, more preferably 9 to 10.

The concentration by phase separation is preferably carried out in the presence of an electrolyte in an amount corresponding to 10 to 10000 ppm of PTFE and/or a fluorine-free anionic surfactant in an amount corresponding to 10 to 10000 ppm of PTFE. When the amount of the electrolyte and/or fluorine-free anionic surfactant is below the range mentioned above, the concentration by phase separation may become difficult in certain instances and, when it is above the range mentioned above, the economical efficiency may be impaired. Further, from the efficiency viewpoint, the concentration by phase separation is preferably carried out in the presence of an electrolyte and a fluorine-free anionic surfactant.

The amount of the electrolyte in the concentration by phase separation is preferably at a level corresponding to not lower than 100 ppm but not higher than 5000 ppm. The amount of the fluorine-free anionic surfactant in the concentration by phase separation is preferably at a level corresponding to not lower than 100 ppm but not higher than 5000 ppm.

The electrolyte is not particularly restricted but includes, among others, sulfuric acid, succinic acid and carbonic acid, and salts of these. Among them, ammonium sulfate is preferred.

The fluorine-free anionic surfactant so referred to herein has emulsifying activity. The fluorine-free anionic surfactant conceptually differs from the above-mentioned electrolyte in its having the above-mentioned activity.

As the fluorine-free anionic surfactant, there may be mentioned a compound whose 0.1% by mass aqueous solution shows a surface tension of, for example not higher than 60 mN/m, preferably not higher than 50 mN/m.

The fluorine-free anionic surfactant is not particularly restricted but may be any one such that the above-mentioned surface tension is within the above range. Thus, mention may be made of alkylsulfuric acids such as laurylsulfuric acid, alkylarylsulfonic acids such as dodecylbenzenesulfonic acid, sulfosuccinic acid alkyl esters, and salts of these, among others. The fluorine-free anionic surfactant may comprise one single species or a combination of two or more of these compounds.

The surface tension value mentioned above is the value measured at 25° C. by the Wilhelmy method.

The sulfosuccinic acid alkyl esters or salts thereof may be monoesters but preferably are diesters.

As the sulfosuccinic acid alkyl esters or salts thereof, there may be mentioned, for example, sulfosuccinic acid alkyl esters or salts thereof represented by the general formula (I):

$$R^1—OCOCH(SO_3A)CH_2COO—R^2 \quad (I)$$

Wherein $R^1$ and $R^2$ are the same or different and each represents an alkyl group containing 4 to 12 carbon atoms and A represents an alkali metal, an alkaline earth metal or $NH_4$.

As the groups $R^1$ and $R^2$ in the above general formula (I), there may be mentioned, for example, such straight-chain or branched alkyl groups as n-butyl, isobutyl, sec-butyl, n-pentyl, isopentyl, neopentyl, tert-pentyl, n-hexyl, isohexyl, tert-hexyl, n-heptyl, isoheptyl, tert-heptyl, n-octyl, isooctyl, tert-octyl, n-nonyl, isononyl, tert-nonyl, n-decyl and 2-ethylhexyl.

Preferred as A in the above general formula (I) are, for example, Na, $NH_4$ and the like. As the sulfosuccinic acid alkyl esters, there may specifically be mentioned, for example, di-n-octyl sulfosuccinate and di-2-ethylhexyl sulfosuccinate.

The fluorine-free anionic surfactant may have an acid group provided that the above-defined surface tension is within the above range.

The acid group is preferably selected from the group consisting of carboxyl, sulfonic acid and phosphoric acid groups and salts thereof, in particular from the group consisting of carboxyl and sulfonic acid groups and salts thereof.

The fluorine-free anionic surfactant so defined herein may further have, in addition to the above-mentioned acid group, one or more of polyoxyalkylene groups whose oxyalkylene group contains 2 to 4 carbon atoms, amino and other groups. The amino group in the surfactant referred to herein is not in the protonated form.

The above-mentioned fluorine-free anionic surfactant is preferably an anionic hydrocarbon-based surfactant comprising a hydrocarbon residue as the main chain. The hydrocarbon residue is, for example, one having a saturated or unsaturated aliphatic chain containing 6 to 40 carbon atoms, preferably 8 to 20 carbon atoms. The saturated or unsaturated aliphatic chain may be straight-chained or branched and may contain a cyclic structure. The hydrocarbon residue may have aromaticity or may contain an aromatic group. The hydrocarbon residue may contain one or more of such hetero atoms as oxygen, nitrogen and sulfur atoms.

As the fluorine-free anionic surfactant, there may more specifically be mentioned alkylsulfonic acids such as laurylsulfonic acid, and salts thereof; alkylaryl sulfates and salts thereof; aliphatic (carboxylic) acids such as lauric acid, and salts thereof; phosphoric acid alkyl esters, phosphoric acid alkylaryl esters, and salts thereof; and so forth. Among them, preferred ones are selected from the group consisting of sulfonic acids and carboxylic acids, and salts thereof; aliphatic carboxylic acids or salts thereof are more preferred. Preferred as the aliphatic carboxylic acids or salts thereof are saturated or unsaturated aliphatic carboxylic acids containing 9 to 13 carbon atoms whose terminal H may be substituted by —OH, or salts thereof, and monocarboxylic acids are preferred as the aliphatic carboxylic acids. Preferred monocarboxylic acids are decanoic acid, undecanoic acid, undecenic acid, lauric acid and hydroxydodecanoic acid.

The fluorine-free anionic surfactant is also preferably a sulfosuccinic acid alkyl ester or a salt thereof, more preferably dioctyl sulfosuccinate or laurylsulfuric acid, or a salt thereof, still more preferably dioctyl sulfosuccinate sodium salt or sodium laurylsulfate.

The concentration by phase separation in the present invention is preferably carried out after adding the above-mentioned electrolyte and/or fluorine-free anionic surfactant to the crude fluororesin aqueous dispersion to give a dispersion showing, at 25° C., an electric conductivity of not lower than 100 μS/cm, preferably not lower than 200 μS/cm. The upper limit to the above-mentioned electric conductivity is not particularly restricted but the conductivity is preferably not higher than 10000 μS/cm, more preferably not higher than 5000 μS/cm.

The electric conductivity so referred to herein is the value measured using an electric conductivity meter (product of ORION).

As the fluorine-free anionic surfactant to be used in the concentration by phase separation, there may be mentioned those specifically mentioned hereinabove referring to the ion-exchange resin treatment and, among them, those nonionic surfactants which show an inorganicity/organicity ratio of 1.07 to 1.50 are preferred. The concentration of the fluorine-free nonionic surfactant in the concentration by phase separation is preferably at a level corresponding to 1 to 40% by mass, more preferably 1 to 30% by mass, still more preferably 1 to 20% by mass, relative to the above-mentioned PTFE. When the concentration of the fluorine-free nonionic surfactant is lower than a level corresponding to 1% by mass, the concentration by phase separation may become difficult in certain cases and, when it is above a level exceeding 40% by mass, the economic efficiency may be impaired.

The concentration by phase separation is carried out after carrying out the ion-exchange resin treatment mentioned above. The concentration by phase separation may also be carried out prior to the ion-exchange resin treatment according to need, without any restriction, provided that it is carried out after the ion-exchange resin treatment mentioned above without fail.

According to The method of producing a fluororesin aqueous dispersion according to the invention, the PTFE concentration in the fluororesin aqueous dispersion obtained can amount to 45 to 75% by mass relative to the fluororesin aqueous dispersion. The concentration mentioned above is preferably not lower than 50% by mass and is preferably not higher than 70% by mass. When the PTFE concentration is within the above range, it becomes possible to reduce the cost of transportation of the fluororesin aqueous dispersion and increase the thickness of the coatings to be obtained.

The fluororesin aqueous dispersion obtained by the method of producing a fluororesin aqueous dispersion according to the invention can have an electrolyte content not exceeding a level corresponding to 10000 ppm, preferably 5000 ppm of the above-mentioned PTFE and/or a fluorine-free anionic surfactant content not exceeding a level corresponding to 10000 ppm, preferably 5000 ppm of the above-mentioned PTFE. The electrolyte content is preferably not lower than a level corresponding to 10 ppm. The fluorine-free anionic surfactant content is preferably not lower than a level corresponding to 10 ppm.

When the electrolyte and/or fluorine-free anionic surfactant is below the range mentioned above, the dispersion stability may be poor in certain instances and, when it is above the above range, the economic efficiency may be impaired.

The fluororesin aqueous dispersion obtained by the method of producing a fluororesin aqueous dispersion according to the invention has a fluorine-containing surfactant content reduced to a level corresponding to 100 ppm of the above-mentioned PTFE or below. Since the fluorine-containing surfactant causes impairments in those characteristics of fluororesins which are excellent, it is important to reduce the content thereof as far as possible. From the ease-of-removal viewpoint, the fluorine-containing surfactant preferably has an average molecular weight not exceeding 1000, more preferably not exceeding 500, and preferably contains 5 to 12 carbon atoms.

As the fluorine-containing surfactant, there may be mentioned fluorine-containing anionic surfactants. As the fluorine-containing anionic surfactants, there may be mentioned, for example, perfluorooctanoic acid and/or a salt thereof (hereinafter "perfluorooctanoic acid and/or a salt thereof" will be sometimes collectively referred to as "PFOA"), perfluorooctylsulfonic acid and/or a salt thereof (hereinafter "perfluorooctylsulfonic acid and/or a salt thereof" will be sometimes collectively referred to as "PFOS") and the like.

In the practice of the invention, the above-mentioned fluorine-containing surfactant preferably comprises a perfluorocarboxylic acid and/or a salt thereof. When the fluorine-containing anionic compound is in the form of a salt, the counter ion forming the salt is, for example, an alkali metal ion or $NH_4^+$. As the alkali metal ion, there may be mentioned $Na^+$ and $K^+$, among others. $NH_4^+$, among others, is preferred as the above-mentioned counter ion. When the above-mentioned PFOA or PFOS is in the form of a salt, the salt is not particularly restricted but may be the ammonium salt, for instance.

According to The method of producing a fluororesin aqueous dispersion according to the invention, the fluororesin aqueous dispersion obtained can have a content of the above-mentioned fluorine-containing surfactant as reduced to a level not exceeding 100 ppm of PTFE. The content of the above-mentioned fluorine-containing surfactant may be preferably lower than a level corresponding to 50 ppm of PTFE, more preferably lower than a level corresponding to 20 ppm of PTFE, still more preferably lower than a level corresponding to 10 ppm of PTFE. Most preferably, it is below the detection limit, namely substantially zero.

The fluorine-containing surfactant content so referred to herein is measured by adding methanol, in an amount equal to that of the fluororesin aqueous dispersion, to the dispersion to cause coagulation and, after Soxhlet extraction, subjecting the extract to high-performance liquid chromatography [HPLC].

The fluorine-free nonionic surfactant content in the fluororesin aqueous dispersion obtained by the method of producing a fluororesin aqueous dispersion according to the invention is preferably at a level corresponding to 0.1 to 15% by mass relative to PTFE. The fluorine-free nonionic surfactant content is preferably not lower than a level corresponding to 0.2% by mass and is preferably not higher than a level corresponding to 10% by mass. When the fluorine-free nonionic surfactant concentration is above a level corresponding to 15% by mass, the economic efficiency may be impaired and, when it is lower than a level corresponding to 0.1% by mass, the dispersion stability of the fluororesin aqueous dispersion may possibly become insufficient.

In spite of their having such fluorine-containing surfactant and fluorine-free nonionic surfactant concentration as within the above-mentioned respective ranges, the fluororesin aqueous dispersion obtained by the method of producing a fluororesin aqueous dispersion according to the invention has good dispersion stability, without being markedly impaired in crack resistance and mechanical stability.

The above-mentioned fluororesin aqueous dispersion can have an electric conductivity, at 25° C., of not lower than 10 μS/cm, preferably not lower than 100 μS/cm. The fluororesin aqueous dispersion, which has an electric conductivity within such range, is excellent in dispersion stability. So long as the electric conductivity is within the above range, the upper limit thereto is not particularly restricted but preferably is 10000 μS/cm, more preferably 5000 μS/cm.

The fluororesin aqueous dispersion obtained by The method of producing a fluororesin aqueous dispersion according to the invention, either as such or after supplementation with one or more of various additives, can be processed into or used in making coatings, cast films, impregnated bodies and so forth. They may be diluted according to need or may be used in admixture with another dispersion.

As the fields of application of the above-mentioned fluororesin aqueous dispersion, there may be mentioned, for example, oven linings, ice trays and like cooking utensils, electric wires, pipes, ship bottoms, high-frequency printed circuit boards, conveyer belts, iron bottom coatings; fibrous substrates, woven and nonwoven fabrics and so forth. The fibrous substrates are not particularly restricted but the dispersions can be processed into impregnated articles using glass fibers, carbon fibers, aramid fibers (Kevlar® fibers etc.) as substrates to be impregnated. Such processing of the fluororesin aqueous dispersion can be carried out by any of the methods known in the art.

The fluororesin aqueous dispersion can also be processed, for example, into fluororesin powders or moldings.

Such fluororesin powders are very low in fluorine-containing surfactant content and, therefore, are useful as excellent molding materials. The fluororesin powders can be prepared by any of the conventional methods according to the intended use thereof.

The method of producing a fluororesin aqueous dispersion according to the invention, which has the constitution described hereinabove, can efficiently produce a fluororesin aqueous dispersion very low in fluorine-containing surfactant content and high in PTFE concentration.

DETAILED DESCRIPTION OF PREFERRED EMBODIMENTS

The following examples and comparative examples illustrate the present invention in further detail. They are, however, by no means limitative of the scope of the invention. In the examples and comparative examples, "part(s)" and "%" are "part(s) by mass" and "% by mass", respectively, unless otherwise specified.

The measurements in each example or comparative example were carried out by the methods described below.

(1) Fluororesin Concentration (P)

About 1 g (X) of each sample was placed in an aluminum cup having a diameter of 5 cm, dried at 100° C. for 1 hour and then further dried at 300° C. for 1 hour. Based on the heating residue (Z), the concentration P was calculated as follows: P=Z/X×100(%).

(2) Fluorine-Containing Surfactant Concentration

The aqueous dispersion obtained was subjected to coagulation treatment by addition of an equal amount of methanol followed by Soxhlet extraction, and the concentration in question was determined by carrying out high-performance liquid chromatography [HPLC] under the conditions given below. In calculating the fluorine-containing surfactant concentration, a working curve constructed by carrying out extraction and HPLC under the same conditions for known fluorine-containing surfactant concentrations was used.

(Measurement Conditions)

Column: ODS-120T (4.6 ø×250 mm, product of Tosoh Corp.)

Developing solution: Acetonitrile/0.6% aqueous perchloric acid solution=1/1 (vol/vol %)

Sample size: 20 μL

Flow rate: 1.0 ml/minute

Detection wavelength: UV 210 nm

Column temperature: 40° C.

(3) Fluorine-Free Nonionic Surfactant Content (N) in Fluororesin Aqueous Dispersion About 1 g (X g) of each sample was placed in an aluminum cup having a diameter of 5 cm and heated at 100° C. for 1 hour to give a heating residue (Y g) and the heating residue (Y g) obtained was further heated at 300° C. for 1 hour to give a heating residue (Z g). Calculation was made as follows: N=[(Y−Z)/Z]×100(%).

(4) Average Primary Particle Diameter of Fluororesin Particles

The average primary particle diameter is determined based on the transmittance, per unit length, of a sample aqueous dispersion adjusted to a PTFE concentration of 0.22% by mass at an incident light wavelength of 550 nm, using a working curve showing the relation between such transmittance and the average primary particle diameter determined by measurements of images on a scanning electron photomicrograph in a predetermined direction.

(5) Electric Conductivity at 25° C.

The electric conductivity was measured using an electric conductivity meter (product of ORION).

(6) Surface Tension

Surface tension measurement was made at 25° C. by the Wilhelmy method.

Example 1

(1) Ion-Exchange Resin Treatment

A 5% aqueous solution (150 L) of the fluorine-free nonionic emulsifier Leocol TD90 (trade name, product of Lion Corp.) was passed, over 1 hour, through a column (30 cm in diameter, 200 cm in height) packed with 150 L of the OH form ion-exchange resin Amberjet IRA40020H (trade name, product of Rohm and Haas).

600 L of a PTFE aqueous dispersion (average primary particle diameter of PTFE particles: 235 nm) adjusted to a fluororesin concentration of 30%, a Leocol TD90 concentration of 5% relative to the fluororesin and a PFOA concentration of 3000 ppm relative to the fluororesin was passed through the above column over 4 hours (space velocity (SV)=0.5), and a PTFE dispersion (fluororesin concentration: 30% by mass, fluorine-free nonionic surfactant concentration: 5%/fluororesin) was obtained. The PFOA concentration in the PTFE dispersion obtained was below the detection limit (10 ppm) and the pH was 10.3.

(2) Concentration by Phase Separation

An amount corresponding to 15% of the fluororesin of Leocol TD90 was further added to the PTFE dispersion obtained by the ion-exchange resin treatment described above under (1) and, after addition of ammonium sulfate in an amount corresponding to 50 ppm of the fluororesin and dioctyl sulfosuccinate (70% methanol solution, surface tension of 0.1% (by mass) aqueous solution at 25° C.: 26 mN/m) in an amount corresponding to 350 ppm of the fluororesin), the dispersion was made up with water to a fluororesin concentration of 23% and further adjusted to pH 9.5 with aqueous ammonia. For the dispersion obtained, the electric conductivity at 25° C. was 1500 μS/cm. This dispersion was allowed to stand at 70° C. for 5 hours; it separated into two phases, namely a substantially fluororesin-free supernatant phase and a concentrated phase. The supernatant phase was removed and the concentrated phase was recovered. Thus was obtained a fluororesin aqueous dispersion having a fluororesin concentration of 64%, a fluorine-free nonionic surfactant concentration at a level corresponding to 5.4% of the fluororesin, an average primary particle diameter of PTFE particles of 235 nm, and an electric conductivity at 25° C. of 580 μS/cm.

Example 2

An amount of Leocol TD90 corresponding to 15% relative to the fluororesin was further added to the PTFE dispersion obtained by ion-exchange resin treatment in Example 1(1), an amount of ammonium sulfate corresponding to 50 ppm of the fluororesin was added, the fluororesin concentration was adjusted to 23% by addition of water and, further, the pH was adjusted to 9.5 with aqueous ammonia. The electric conductivity at 25° C. of the dispersion obtained was 1480 μS/cm. This dispersion was allowed to stand at 70° C. for 5 hours; it separated into two phases. The supernatant phase was removed, and the concentrated phase was recovered. Thus was obtained a fluororesin aqueous dispersion having a fluororesin concentration of 62%, a fluorine-free nonionic surfactant concentration at a level corresponding to 5.1% of the fluororesin, an average primary particle diameter of PTFE particles of 235 nm, and an electric conductivity at 25° C. of 480 μS/cm.

Example 3

An amount of Leocol TD90 corresponding to 15% relative to the fluororesin was further added to the PTFE dispersion obtained by ion-exchange resin treatment in Example 1(1), an amount of dioctyl sulfosuccinate (70% methanol solution) corresponding to 350 ppm of the fluororesin was added, the fluororesin concentration was adjusted to 23% by addition of water and, further, the pH was adjusted to 9.5 with aqueous ammonia. The electric conductivity at 25° C. of the dispersion obtained was 250 μS/cm. This dispersion was allowed to stand at 70° C. for 5 hours; it separated into two phases. The supernatant phase was removed, and the concentrated phase was recovered. Thus was obtained a fluororesin aqueous dispersion having a fluororesin concentration of 61%, a fluorine-free nonionic surfactant concentration at a level corresponding to 5.0% relative to the fluororesin, an average primary particle diameter of PTFE particles of 235 nm, and an electric conductivity at 25° C. of 130 μS/cm.

Example 4

An amount of Leocol TD90 corresponding to 15% relative to the fluororesin was further added to the PTFE dispersion obtained by ion-exchange resin treatment in Example 1(1), an amount of ammonium sulfate corresponding to 600 ppm of the fluororesin was added, the fluororesin concentration was adjusted to 23% by addition of water and, further, the pH was adjusted to 9.5 with aqueous ammonia. The electric conductivity at 25° C. of the dispersion obtained was 2100 μS/cm. This dispersion was allowed to stand at 70° C. for 5 hours; it separated into two phases. The supernatant phase was removed, and the concentrated phase was recovered. Thus was obtained a fluororesin aqueous dispersion having a fluororesin concentration of 63%, a fluorine-free nonionic surfactant concentration at a level corresponding to 4.9% of the fluororesin, an average primary particle diameter of PTFE particles of 235 nm, and an electric conductivity at 25° C. of 600 μS/cm.

Example 5

An amount of Leocol TD90 corresponding to 15% relative to the fluororesin was further added to the PTFE dispersion obtained by ion-exchange resin treatment in Example 1(1), an amount of ammonium sulfate corresponding to 55 ppm of the fluororesin was added, the fluororesin concentration was adjusted to 23% by addition of water and, further, the pH was adjusted to 9.5 with aqueous ammonia. The electric conductivity at 25° C. of the dispersion obtained was 1500 μS/cm. This dispersion was allowed to stand at 70° C. for 5 hours; it separated into two phases. The supernatant phase was removed, and the concentrated phase was recovered. Thus was obtained a fluororesin aqueous dispersion having a fluororesin concentration of 62%, a fluorine-free nonionic surfactant concentration at a level corresponding to 4.8% of the fluororesin, an average primary particle diameter of PTFE particles of 235 nm, and an electric conductivity at 25° C. of 490 μS/cm.

Example 6

An amount of Leocol TD90 corresponding to 15% relative to the fluororesin was further added to the PTFE dispersion obtained by ion-exchange resin treatment in Example 1(1), an amount of ammonium sulfate corresponding to 60 ppm of the fluororesin was added, the fluororesin concentration was adjusted to 23% by addition of water and, further, the pH was adjusted to 9.5 with aqueous ammonia. The electric conductivity at 25° C. of the dispersion obtained was 1550 μS/cm. This dispersion was allowed to stand at 70° C. for 5 hours; it separated into two phases. The supernatant phase was removed, and the concentrated phase was recovered. Thus was obtained a fluororesin aqueous dispersion having a fluororesin concentration of 63%, a fluorine-free nonionic surfactant concentration at a level corresponding to 5.0% of the fluororesin, an average primary particle diameter of PTFE particles of 235 nm, and an electric conductivity at 25° C. of 500 μS/cm.

Example 7

An amount of Leocol TD90 corresponding to 15% relative to the fluororesin was further added to the PTFE dispersion obtained by ion-exchange resin treatment in Example 1(1), an amount of ammonium sulfate corresponding to 35 ppm of the fluororesin was added, the fluororesin concentration was adjusted to 23% by addition of water and, further, the pH was adjusted to 9.5 with aqueous ammonia. The electric conductivity at 25° C. of the dispersion obtained was 1450 μS/cm. This dispersion was allowed to stand at 70° C. for 5 hours; it separated into two phases. The supernatant phase was removed, and the concentrated phase was recovered. Thus was obtained a fluororesin aqueous dispersion having a fluororesin concentration of 62%, a fluorine-free nonionic surfactant concentration at a level corresponding to 4.5% of the fluororesin, an average primary particle diameter of PTFE particles of 235 nm, and an electric conductivity at 25° C. of 400 μS/cm.

Example 8

An amount of Leocol TD90 corresponding to 15% relative to the fluororesin was further added to the PTFE dispersion obtained by ion-exchange resin treatment in Example 1(1), an amount of ammonium sulfate corresponding to 30 ppm of the fluororesin was added, the fluororesin concentration was adjusted to 23% by addition of water and, further, the pH was adjusted to 9.5 with aqueous ammonia. The electric conductivity at 25° C. of the dispersion obtained was 1400 μS/cm. This dispersion was allowed to stand at 70° C. for 5 hours; it separated into two phases. The supernatant phase was removed, and the concentrated phase was recovered. Thus was obtained a fluororesin aqueous dispersion having a fluororesin concentration of 63%, a fluorine-free nonionic surfactant concentration at a level corresponding to 4.6% of the fluororesin, an average primary particle diameter of PTFE particles of 235 nm, and an electric conductivity at 25° C. of 380 μS/cm.

Comparative Example 1

An amount of Leocol TD90 corresponding to 15% relative to the fluororesin was further added to the PTFE dispersion obtained by ion-exchange resin treatment in Example 1(1), the fluororesin concentration was adjusted to 23% by addition of water and, further, the pH was adjusted to 9.5 with aqueous ammonia. The electric conductivity at 25° C. of the dispersion obtained was 200 μS/cm. This dispersion was allowed to stand at 70° C. for 5 hours; it separated into two phases. The supernatant phase was removed, and the concentrated phase was recovered. Thus was obtained a fluororesin aqueous dispersion having a fluororesin concentration of 53%, a fluorine-free nonionic surfactant concentration at a level corresponding to 3.1% relative to the fluororesin, an average primary particle diameter of PTFE particles of 235 nm, and an electric conductivity at 25° C. of 150 μS/cm.

The method of producing a fluororesin aqueous dispersion according to the invention is suited for use in obtaining a fluororesin aqueous dispersion capable of being processed into coatings, cast films, impregnated articles and the like.

What is claimed is:

1. A method of producing a fluororesin aqueous dispersion which comprises subjecting a crude fluororesin aqueous dispersion comprising a polytetrafluoroethylene particle dispersed in an aqueous medium to treatment with an ion-exchange resin, and to treatment for concentration by phase separation in the presence of an electrolyte after carrying out the ion-exchange resin treatment, wherein the electrolyte comprises at least one species selected from the group consisting of sulfuric acid, succinic acid, carbonic acid, and salts thereof.

2. The method of producing a fluororesin aqueous dispersion according to claim 1, wherein the treatment for concentration by phase separation is carried out in the presence of an electrolyte in an amount corresponding to 10 to 10000 ppm of the polytetrafluoroethylene.

3. The method of producing a fluororesin aqueous dispersion according to claim 1, wherein the polytetrafluoroethylene particle has an average particle diameter of 40 to 400 nm.

4. The method of producing a fluororesin aqueous dispersion according to claim 1 which has a polytetrafluoroethylene concentration of 45 to 75% by mass relative to said fluororesin aqueous dispersion, an electrolyte content not exceeding a level corresponding to 10000 ppm of said polytetrafluoroethylene, and a fluorine-containing surfactant content not exceeding a level corresponding to 100 ppm of said polytetrafluoroethylene.

5. A fluororesin aqueous dispersion as obtained by the method of producing a fluororesin aqueous dispersion according to claim 1, said fluororesin aqueous dispersion containing the electrolyte.

* * * * *